United States Patent [19]

Lesquir et al.

[11] Patent Number: 4,940,268

[45] Date of Patent: Jul. 10, 1990

[54] TAMPER-PROOF TAG

[76] Inventors: Dominique Lesquir, 1197 Rang St., Rockland Quebec, Canada; Bernard Landry, 1256 Fontenay St., St. Foy Quebec, Canada

[21] Appl. No.: 434,215

[22] Filed: Nov. 13, 1989

[51] Int. Cl.[5] ..... B65D 33/34

[52] U.S. Cl. ..... 292/317; 292/318

[58] Field of Search ..... 292/316, 317, 318, 319, 292/320, 321, 322

[56] References Cited

U.S. PATENT DOCUMENTS 715,822 12/1902 Liemke ..... 292/320
1,866,461 7/1932 Goschnick ..... 292/319
3,954,294 5/1976 Iwamoto et al. ..... 292/318
4,697,833 10/1987 Swift ..... 292/318

*Primary Examiner*—Richard E. Moore

*Attorney, Agent, or Firm*—James R. Longacre; Michael L. Keller

[57] ABSTRACT

A tamper-proof tag which is made of a unitary body, formed of molded plastic material, and comprises a fastener connected to a flexible strap, the latter being foldable into a ring and engageable into a catch defined at one end of the strap. The fastener is so configured that, once received in the catch, it may be forcingly engaged into one of a series of holes in the strap. Once engaged, the fastener can no longer be removed without damaging the tag.

6 Claims, 3 Drawing Sheets

TAMPER-PROOF TAG

FIELD OF THE INVENTION

The present invention relates to a tamperproof tag and, more particularly, to the type of tag which will be damaged if tampered with.

OBJECTS AND STATEMENT OF THE INVENTION

It is an object of the present invention to provide a tag which cannot be opened or falsified without thereafter displaying an apparent marking.

The present invention relates to a tamperproof tag which consists of a unitary body formed of molded plastic material, which comprises:

a fastener defining a T-shaped body having a stem portion and a head portion; the head portion has, at each opposite end thereof, a depending flexible arm; the stem portion displays an enlarged extremity with a cross-section greater than that of the stem portion;

a flexible strap including an elongate portion displaying, from one end thereof and for a major portion thereof, a series of aligned holes, which have a cross-section smaller than that of the enlarged extremity of the stem portion but slightly greater than that of the remaining stem portion thereof; the strap further includes, at an opposite end thereof, a catch for receiving therein the opposite end of the elongate portion and the strap; the catch defines a slot having a cross-section slightly greater than that of the elongate portion when folded to define a ring, and further defines an entrance for receiving therein the fastener whereby the stem portion may be engaged with the folded elongate portion by forcingly introducing the enlarged end in one of the holes; the enlarged extremity is shaped so that, once introduced in the hole, it can not be removed therefrom; and flexible means connecting the fastener to the catch.

In one preferred form of the invention, the arms are made to flex by having reduced areas in the joining sections of the arms with the head portion of the fastener.

In another embodiment, the catch defines a housing which entirely encloses the arms of the fastener so that the connected parts of the tag cannot be reached.

Other objects and further scope of applicability of the present invention will become apparent from the detailed description given hereinafter. It should be understood, however, that this detailed description, while indicating preferred embodiments of the invention, is given by way of illustration only, since various changes and modifications within the spirit and scope of the invention will become apparent to those skilled in the art.

IN THE DRAWINGS

DESCRIPTION OF PREFERRED EMBODIMENTS

Figure 1:
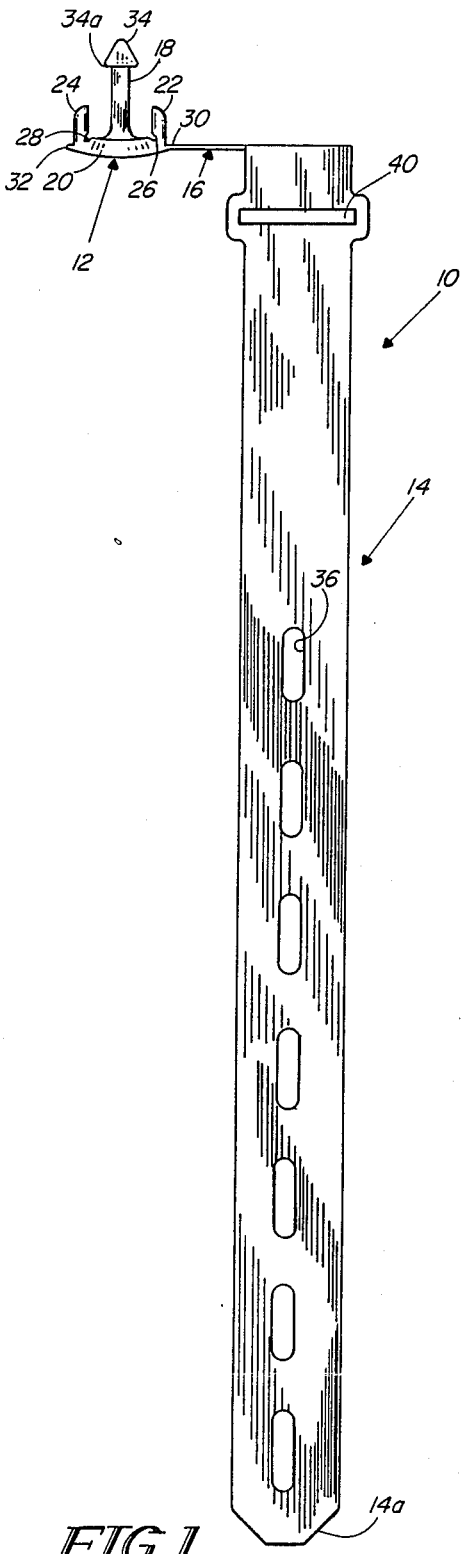
FIG. 1 is a front elevational view of the tag made in accordance with the present invention.
Figure 2:
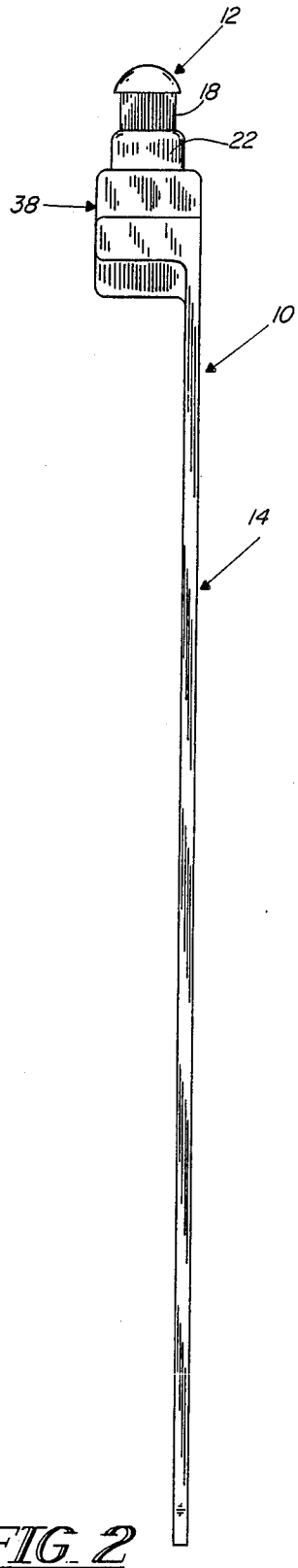
FIG. 2 is a side elevational view of the tag.
Figure 3:
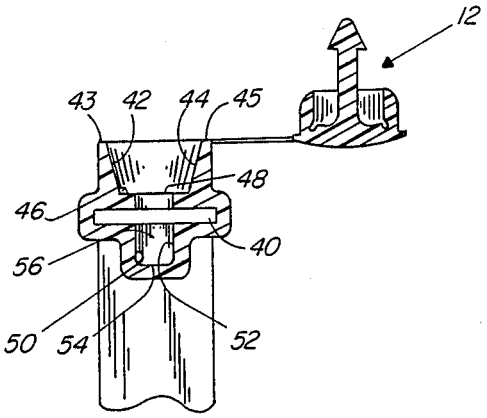
FIGS. 3, 4 and 5 are cross-sectional views showing three successive steps in the engagement of the fastener into the catch of the strap.

Referring to FIGS. 1 and 2, there is shown a tamperproof tag, generally denoted at 10, which consists of a unitary body formed of molded plastic material such as polyethylene; it comprises three parts: a fastener 12, a strap 14 and a flexible connecting band 16.

The fastener 12 defines a T-shaped body having a stem portion 18 and a head portion 20, the latter displaying, at opposite ends thereof, depending arms 22 and 24 which are flexible relative to the head 20 due to the reduced areas 26 and 28 at their joining. The head portion 20 displays a curved outer surface with opposite flanges 30 and 32. The stem portion 18 has an enlarged extremity 34 in the shape of an arrow head, the cross-section of which is larger than that of the remaining stem portion 18.

The strap 14 consists of an elongate body displaying a series of aligned elongated holes 36, the width of which is smaller than that of the base **34*a* of the arrow head 34, but slightly larger than the cross-section of the remaining stem portion 18. The upper part of the strap terminates in the form of a catch, generally denoted 38, which is shaped as a housing which is traversed by a flat rectangular slot 40. The housing is defined by a pair of opposite inwardly tapering inner side walls 42 and 44 contiguous with horizontal short walls 46 and 48, the latter contiguous with respective opposite vertical walls 50 and 52 which define, with the bottom wall 54, a cavity 56**.

Figure 4:
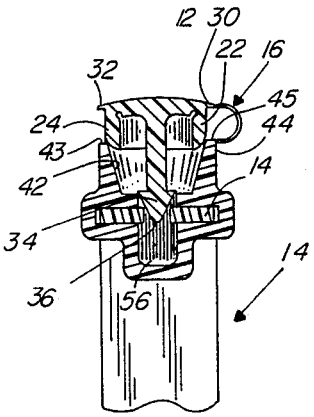
Figure 5:
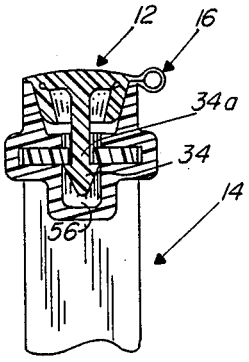
Figure 6:
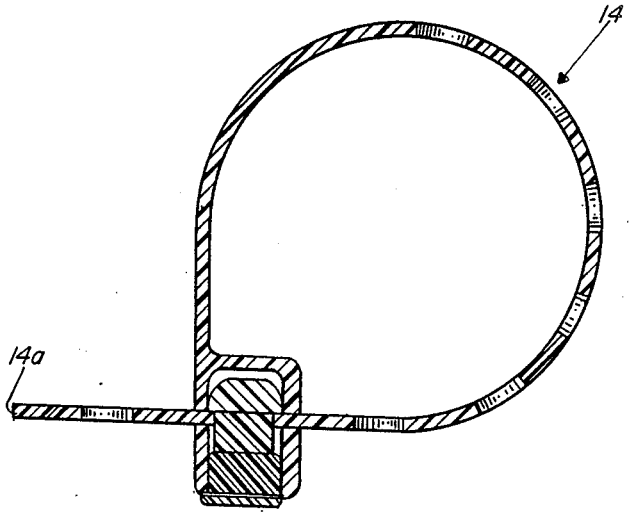
FIG. 6 is an elevational view of the tag in the engaged position.

Referring to FIGS. 4, 5 and 6, the engagement of the tag is accomplished by folding strap 14 into a ring and inserting its free end **14*a* through the slot 40; one of the holes 36 is located in alignment over the cavity 56 (see FIG. 4). The fastener 12 is then folded into the housing with the arms 22 and 24 slidingly contacting the tapering walls 44 and 42, respectively. The enlarged extremity 34 of the fastener is forced through the small holes 36 of the strap located in the strap and is then received in the cavity 56 (see FIG. 5). The downward movement of the fastener is stopped by the contacting of the flanges 30 and 32 with the upper edges 43 and 45** of the catch.

In the engaged position, the shoulder areas **34*a*** of the arrow-head are in abutment with the undersurface of the strap adjacent the hole thereby preventing removal of the fastener from the catch.

To further ensure the tamper-proof feature of the present invention, the flanges 30 and 32 cover the upper edges 43 and 45 (see FIG. 5) thereby preventing access to the connected parts inside the housing.

Although the invention has been described above with respect with one specific form, it will be evident to the person skilled in the art that it may be modified and refined in various ways. It is therefore wished to have it understood that the present invention should not be limited in scope, except by the terms of the following claims.

The embodiments of the invention in which an exclusive property or privilege is claimed are defined as follows:

1. A tamper-proof tag consisting of a unitary body formed of molded plastic material and comprising:

(i) a fastener defining a T-shaped body having a stem portion and a head portion; said head portion having, at each opposite end thereof, a depending flexible arm; said stem portion displaying an enlarged extremity having a cross-section greater than that of said stem portion;

(ii) a flexible strap including an elongate portion displaying, from one end thereof and for a major portion thereof, a series of aligned openings, said openings having a cross-section smaller than that of said enlarged extremity of said fastener but slightly greater than that of said stem portion thereof; said strap further including, at an opposite end thereof, a catch for receiving therethrough said one end of said elongate portion and for receiving therein said fastener; said catch defining a slot having a cross-section slightly greater than that of said elongate portion, and an entrance for receiving therein said fastener whereby said stem portion is engaged with said folded elongate portion by forcingly introducing said enlarged extremity through one of said openings; said enlarged extremity being shaped so that, once introduced in said opening, it can not be removed therefrom; and (iii) flexible means connecting said fastener to said catch.

2. A tamper-proof tag as defined in claim 1, wherein each said arm is made to flex by having reduced areas in the region where said arm is connected to said head portion.

3. A tamper-proof tag as defined in claim 2, wherein said entrance of said catch includes opposite side walls inwardly and centrally tapering whereby said arms flex inwardly as they are introduced and contactingly engage said sidewalls.

4. A tamper-proof tag as defined in claim 1, wherein said catch defines a housing entirely enclosing said arms and said enlarged extremity when in engagement in said catch.

5. A tamper-proof tag as defined in claim 4, wherein said head portion of said fastener covers the entrance of said catch to fully close said housing.

6. A tamper-proof tag as defined in claim 5, wherein said head portion has a flange on opposite sides thereof for resting over corresponding upper edges of said catch when said fastener is received in said catch.

* * * * *